US010297153B2

(12) United States Patent
Gao et al.

(10) Patent No.: US 10,297,153 B2
(45) Date of Patent: May 21, 2019

(54) VEHICLE ON-BOARD CONTROLLER CENTERED TRAIN CONTROL SYSTEM

(71) Applicant: Traffic Control Technology Co., Ltd, Beijing (CN)

(72) Inventors: Chunhai Gao, Beijing (CN); Qiang Zhang, Beijing (CN); Junguo Sun, Beijing (CN)

(73) Assignee: Traffic Control Technology Co., Ltd, Beijing (CN)

( * ) Notice: Subject to any disclaimer, the term of this patent is extended or adjusted under 35 U.S.C. 154(b) by 0 days.

(21) Appl. No.: 15/823,318

(22) Filed: Nov. 27, 2017

(65) Prior Publication Data

US 2019/0114914 A1 Apr. 18, 2019

(30) Foreign Application Priority Data

Oct. 17, 2017 (CN) ..... 2017 1 0977491

(51) Int. Cl.
*B61L 27/00* (2006.01)
*G08G 1/0967* (2006.01)
*G08G 1/0968* (2006.01)

(52) U.S. Cl.
CPC .... *G08G 1/096822* (2013.01); *B61L 27/0016* (2013.01); *B61L 27/0027* (2013.01); *G08G 1/096775* (2013.01); *G08G 1/096791* (2013.01); *G08G 1/096833* (2013.01)

(58) Field of Classification Search
None
See application file for complete search history.

(56) References Cited

U.S. PATENT DOCUMENTS 5,751,569 A * 5/1998 Metel ..... B61L 21/00 246/3
5,828,979 A * 10/1998 Polivka ..... B61L 27/0016 701/117
6,135,396 A * 10/2000 Whitfield ..... B61L 3/125 246/167 R (Continued)

FOREIGN PATENT DOCUMENTS

CN 102653278 A 9/2012
WO WO2016022635 A1 2/2016

OTHER PUBLICATIONS

The extended European search report dated May 16, 2018 for European application No. 17199208.4, 9 pages.

*Primary Examiner* — Navid Ziaeianmehdizadeh
(74) *Attorney, Agent, or Firm* — Law Offices of Liaoteng Wang

(57) ABSTRACT

The present disclosure discloses a vehicle on-board controller centered train operation control system, the control system comprises intelligent vehicle controllers (IVOCs) provided on respective trains, the IVOC comprises a vehicle-vehicle communication device, an active identification device and a master control device. With such control system, rear-end train or more serious accidents may be avoided in case that there is a train without communication equipment or with equipment failure operation in front, or an obstruction impeding train operation appears in front of the train. Further, the control system provided by embodiments of the present disclosure enables a train to operate with a relatively high speed under the premise of safe operation, and improves operation efficiency and reliability.

15 Claims, 6 Drawing Sheets

(56) References Cited

U.S. PATENT DOCUMENTS 7,343,314 B2 * 3/2008 Matheson ..... B61L 27/0016 701/19
8,295,999 B2 * 10/2012 Groves ..... B61L 27/0038 246/2 R
2003/0222180 A1 * 12/2003 Hart ..... B61L 27/0038 246/167 R
2006/0030978 A1 * 2/2006 Rajaram ..... B61L 25/021 701/19
2007/0260367 A1 * 11/2007 Wills ..... B61L 27/0027 701/19
2008/0315044 A1 * 12/2008 Stull ..... B61L 27/0005 246/5
2010/0256843 A1 * 10/2010 Bergstein ..... B60T 17/228 701/19
2010/0299007 A1 * 11/2010 Ghaly ..... B61L 3/008 701/20
2011/0172856 A1 * 7/2011 Kull ..... B61L 15/0027 701/19
2011/0238241 A1 * 9/2011 Brady ..... B61L 25/025 701/19
2013/0194423 A1 * 8/2013 Baines ..... B61L 29/28 348/148
2013/0218375 A1 * 8/2013 Ning ..... B61L 23/14 701/19
2014/0129061 A1 * 5/2014 Cooper ..... B61L 15/0036 701/19
2014/0131524 A1 * 5/2014 Grimm ..... B61L 27/00 246/3
2015/0102177 A1 * 4/2015 Tippey ..... B61L 15/0027 246/122 R
2015/0232110 A1 * 8/2015 Ghaly ..... B61L 27/0055 246/62
2015/0302752 A1 * 10/2015 Holihan ..... G08G 1/164 246/62
2016/0016596 A1 * 1/2016 Naylor ..... B61L 15/0027 709/220
2016/0046308 A1 * 2/2016 Chung ..... B61L 25/025 701/20
2016/0121912 A1 * 5/2016 Puttagunta ..... B61L 23/34 701/19
2016/0152253 A1 * 6/2016 Katz ..... B61L 15/0081 246/167 R
2016/0221592 A1 * 8/2016 Puttagunta ..... B61L 23/34
2018/0111633 A1 * 4/2018 Abrosimov ..... B61L 27/0077
2018/0281831 A1 * 10/2018 Adomeit ..... B61L 11/08

* cited by examiner

VEHICLE ON-BOARD CONTROLLER CENTERED TRAIN CONTROL SYSTEM

CROSS-REFERENCE TO RELATED APPLICATION

This application is based upon and claims priority to Chinese Patent Application No. 201710977491.9, filed on Oct. 17, 2017, which is incorporated herein by reference in its entirety.

FIELD

The present disclosure relates to the field of rail transportation, and more particularly, to a vehicle on-board controller centered train operation control system.

BACKGROUND

Communication-based Train Control (CBTC) uses communication media for two-way communication between a train and ground equipment, as a replacement for track circuit for medium achieving train operation control.

Traditional CBTC system concentrates on ground control. A train is registered with a Zone Controller (ZC), under control of the ZC, and take the initiative to report to the ZC. ZC calculates the movement authority (MA) for trains within its managing scope, it realizes interaction of vehicle-ground information through continuous vehicle-ground two-way wireless communication, and tracks operation under target-distance based mobile blocking system. However, traditional CBTC systems need a plurality of devices and have complex interfaces, with huge amount of data exchange. Further, because of presence of delays in the transmission of vehicle-ground transmission, instantaneity of a system is limited, as well as train operation control flexibility and intelligence level.

Due to the shortcomings in a traditional CBTC system and for high safe and efficient operation requirements of a rail transit system, vehicle-vehicle communication based CBTC system rose in response. A vehicle-vehicle communication based CBTC system reduces the number of ground devices, and uses a Vehicle on-board controller (VOBC) as it core. Based on direct communications between trains, a train directly obtains information about vehicles in front or behind it (e.g. train location and speed), it control the speed of the train to prevent collision or rear-end, to make more flexible control of the train so as to improve its the operational efficiency.

However, a vehicle-vehicle communication based CBTC system depends on direct communications between trains, once there is a train without communication equipment or with equipment failure operation in front, the train is unable to learn the operation information that there are other trains in front, causing wrong MA of the train, and therefore resulting in serious danger. In addition, if an obstruction appears in front of the train (e.g., accidental intrusion of objects, or other vehicles stops on the train tracks temporary, or trees or other obstructions on the tracks due to extreme weather), existing vehicle-vehicle communication based CBTC system cannot identify obstacles, so that the train cannot stop in time, causing danger for the train, and even worse, for passengers, an aftermath may be extremely serious.

SUMMARY

An embodiment of the present disclosure provides a vehicle on-board controller centered train operation control system. With such system, rear-end accidents may be prevented effectively and safety of train operation may be improved.

According to an aspect of the present disclosure, a vehicle on-board controller centered train operation control system is provided an embodiment of the present disclosure, the control system comprising an intelligent vehicle on-board controller (IVOC) provided on respective trains, the IVOC comprises a vehicle-vehicle communication device, an active identification device and a master control device.

The vehicle-vehicle communication device is for information exchange between trains and obtaining current operation information of other trains, and transmitting current operation information of the other trains to the master control device. Wherein the current operating information comprises but is not limited to current position, direction and speed of operation of the train.

The active identification device is for determining whether an obstacle exists in front of the train. In case that it is determined that an obstacle exists, the distance between the obstacle and the train is determined and an identification result is transmitted to the master control device. Wherein the identification result comprises a determination result and a distance between the obstacle and the vehicle when existence of the obstacle is determined. Wherein recognizable distance of the active identification device is greater than the emergency braking moving distance of the present train and is not greater than the minimum safe operation distance between adjacent trains.

The master control device is for receiving the current operation information of other trains transmitted by the vehicle-vehicle communication device, and the identification result transmitted by the active identification device; determining the adjacent train in front capable of communication based on current operation information of the present train and current operation information of other trains, calculating a first MA based on the current operation information of the train and the current operation information of the adjacent train in front capable of communication. In case that the identification result indicates that there is no obstacle, the first MA is determined as final MA of the present train. In case that the identification result indicates that there is an obstacle, a second MA is determined according to a distance in the identification result, the final MA of the present train is determined based on the first MA and the second MA.

BRIEF DESCRIPTION OF THE DRAWINGS

Other features, objects, and advantages of the present disclosure will become more apparent from a reading of the following detailed description of a non-limiting example with reference to the accompanying drawings in which like or similar reference numerals refer to like or similar features.

DETAILED DESCRIPTION

Figure 1:
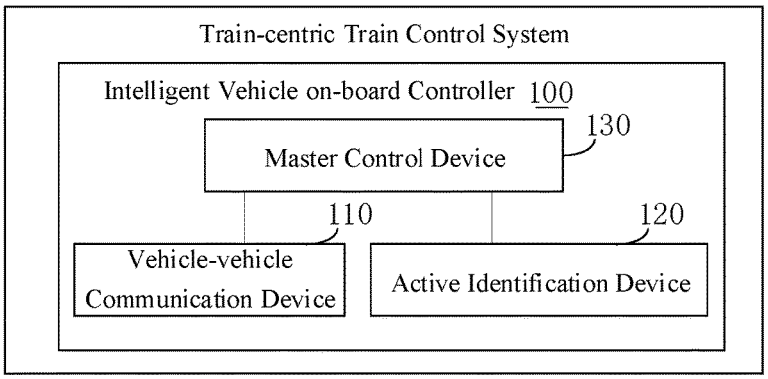
FIG. 1 is a schematic diagram of a vehicle on-board controller centered train operation control system in an embodiment of the present disclosure.

Features and exemplary embodiments of various aspects of the present disclosure will be described in detail below. In the following detailed description, numerous specific details are set forth in order to provide a thorough understanding of the present disclosure. It will be apparent, however, to a person skilled in the art that the present disclosure may be practiced without the need for some of the details in these specific details. The following description of the embodiments is merely for the purpose of providing a better understanding of the present disclosure by showing examples of the present disclosure. The present disclosure is by no means limited to any of the specific configurations and algorithms set forth below, but is intended to cover any modifications, substitutions, and improvements of elements, components and algorithms, without departing from spirit of the invention. In the drawings and the following description, well-known structures and techniques are not shown, in order to avoid unnecessarily obscuring the present disclosure.

Current vehicle-vehicle communication based CBTC system mainly exchanges information with IVOC of trains in front of and behind it, Object Controller (OC) and intelligent Train monitoring (ITS) system using IVOC installed thereon, to achieve independent calculation of MA of the train. Vehicle-vehicle communication based CBTC system not only greatly reduces the construction and maintenance costs of railside equipment, but also has a more flexible control of train intervals, thereby enhancing operational efficiency of trains. However, a vehicle-vehicle communication based CBTC system depends on the direct communication between trains; once there is a train without communication equipment or with equipment failure operation in front, or an obstruction impeding train operation appears in front of the train, the train is unable to obtain MA correctly, and therefore resulting in serious danger. Therefore, a more comprehensive and safer train operation control system is required.

FIG. 1 shows a schematic diagram of a Train-centric Train Control System (TCTCS) with an IVOC as a core provided in an embodiment of the present disclosure. As shown in FIG. 1, the TCTCS of an embodiment of the present disclosure comprises an Intelligent Vehicle on-board controller (IVOC) 100 provided on each train, and the IVOC 100 comprises a vehicle-vehicle communication device 110, an active identification device 120, and a master control device 130.

The vehicle-vehicle communication device 110 is for information exchange between trains and obtaining current operation information of other trains, and transmitting current operation information of the other trains to the master control device 130. Wherein the current operating information comprises but is not limited to current position, direction and speed of operation of the train.

The active identification device 120 is for determining whether an obstacle exists in front of the train. In case that it is determined that an obstacle exists, the distance between the obstacle and the train is determined and an identification result is transmitted to the master control device 130. Wherein the identification result comprises a determination result and a distance between the obstacle and the vehicle when existence of the obstacle is determined. Wherein recognizable distance of the active identification device 120 is greater than the emergency braking moving distance of the present train and is not greater than the minimum safe operation distance between adjacent trains.

The master control device is 130 for receiving the current operation information of other trains transmitted by the vehicle-vehicle communication device 110, and the identification result transmitted by the active identification device 120; determining the adjacent train in front capable of communication based on current operation information of the present train and current operation information of other trains, calculating a first MA based on the current operation information of the train and the current operation information of the adjacent train in front capable of communication. In case that the identification result indicates that there is no obstacle, the first MA is determined as final MA of the present train. In case that the identification result indicates that there is an obstacle, a second MA is determined according to a distance in the identification result, the final MA of the present train is determined based on the first MA and the second MA.

In the TCTCS provided by an embodiment of the present disclosure, the 0 communication device 110 and the active identification device 120 are integrated in the IVOC 100 simultaneously. Calculation of MA of train is no longer dependent solely on communication between the trains, but rather the integrated judgment and determination of the train MA is realized by combination of the vehicle-vehicle communication device 110 and the active identification device 120. Specifically, in case that identification result of the active identification device 120 indicates that there is no obstacle, it indicates that there is no obstacle affecting train operation within recognizable distance of the active identification device 120; further, since the recognizable distance of the active identification device 120 is greater than that the first MA, the first MA (which is calculated based on the vehicle-vehicle communication device 110) can be directly used as the final MA of the train. The active identification device 120 serves as an auxiliary device of the TCTCS, this avoids the situation that an emergency braking cannot be performed when an obstacle appears within recognizable distance of the active identification device 120. It avoids the occurrence of danger, as well as ensures efficiency of train operation.

When identification result of the active identification device 120 is that an obstacle exists, it is necessary to determine a final MA of the train comprehensively based on the first MA (which is calculated by the vehicle-vehicle communication device 110) and the second MA (which is calculated by the active identification device 120) according to actual application scenarios, so as to ensure safety of train operation.

In an embodiment of the present disclosure, an obstacle comprises other trains that affect the safe operation of the present train and/or other objects that impede safe operation of the present train, for example, a fault train in front of the present train, other equipment parked on or aside of the track, a tree fallen on the track, and so on.

In an embodiment of the present disclosure, an adjacent train in front of the present train identified by the master control device 130 based on the information transmitted from the vehicle-vehicle communication device 110 refers to an adjacent train that runs in front of the present train, with vehicle-vehicle communication device is installed that works properly. Such adjacent train may not be literary the adjacent train, because that a true "adjacent train" may not installed with vehicle-vehicle communication device or its vehicle-vehicle communication device may be in malfunction. Under this circumstance, the master control device 130 cannot recognize the true adjacent train based on the vehicle-vehicle communication device. Therefore, in an embodiment of the present disclosure, a train in front of the present train that is identified by the master control device 130 based on the vehicle-vehicle communication device 110 refers to "a train in front capable of communication".

It is to be noted that in an embodiment of the present disclosure, recognizable distance of the active identification device 120 refers to a straight line recognizable distance. That is, recognizable distance is the distance between ahead of a train and the maximum distance in front of the train that is recognizable for the active identification device 120.

In an embodiment of the present disclosure, recognizable distance of the active identification device 120 is greater than emergency braking running distance (i.e., the distance that a train would keep running after an emergency braking) of the present train. In case that an obstacle is found in front of a train and an emergency braking is required, it eliminates the possibility of collision or rear-end with the obstacle even after the emergency braking. Recognizable distance of the active identification device 120 is not greater than the minimum safe operation distance between adjacent trains (i.e., train tracking operation interval), which may effectively reduce the number of times that the second MA is calculated, thereby save system resources.

With TCTCS of an embodiment of the present disclosure, a safe and reasonable MA is provided for a train though combination of the vehicle-vehicle communication device 110 and the active identification device 120. It improves safety of the train and ensure safe operation of the train, and ensures the operation efficiency of the train at the same time, which better meets the practical needs.

In an embodiment of the present disclosure, the master control device 130 is configured to determine the second MA as the final MA in case that a running end of the first MA is in front of a running end of the second MA, and to determine the first MA or the second MA as the final MA in case that the running end of the second MA is in front of the running end of the first MA.

In practice, if the active identification device 120 determines that there is an obstacle in the front, and that a running end of the MA calculated based on identification result of the active identification device 120 is behind a running end of the MA calculated by the vehicle-vehicle communication device 110, current MA for the present train is determined according to the identification result of the active identification device 120 (that is, determining the second MA as the final MA), so as to avoid collision accident caused by operations according to the first MA; so as to ensure safe operation of the train. If the active identification device 120 determines that there is an obstacle in the front, and that a running end of the MA calculated based on identification result of the active identification device 120 is in front of a running end of the MA calculated by the vehicle-vehicle communication device 110, it is indicated that there is no operational obstacle within the distance to the run end of the second MA, and either the first MA or the second MA may serve as the final MA. In practice, it is preferable to determine the second MA as the final MA. Because that when the second MA serves as the final MA, current operation speed of the train may be accelerated according to the MA. It ensures safety of train operation while improve efficiency thereof.

It should be noted that, in an embodiment of the present disclosure, the phases "the front" or "behind" are relative concept with respect to moving direction of the train.

Figure 2:
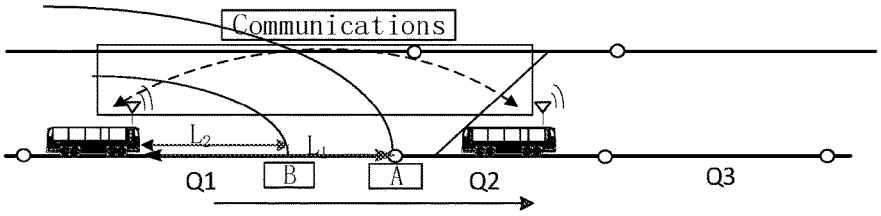
FIG. 2 is a schematic diagram of a specific application scenario of a train operation control system according to an embodiment of the present disclosure.

FIG. 2 shows a particular application scenario in an embodiment of the present disclosure, wherein on left side of is the present train, the two long parallel lines in the figure are two operating tracks, and each circle on the tracks represents a train station; Q1, Q2, Q3 said inter-station sections. In a particular embodiment, the present train is running on section Q1, and the unidirectional arrow in the figure indicates that the operation direction of the present train is from left to right; and point A is the current running end of the first MA (i.e., the running end of the MA calculated by the vehicle-vehicle communication device 110); and $L_1$ is the current safe operation distance of the train corresponding to the first MA. The identification result of the active identification device 120 is that there is no obstacle, and point B is the end of the recognizable distance of the active identification device 120 (i.e., $L_2$ is the recognizable distance of the active identification device 12). Under this circumstance, the first MA calculated based on the vehicle-vehicle communication device 110 serves as the final MA; and the active identification device 120 serves as the safe operation auxiliary device. Since there is no obstacle within the recognizable distance, it is possible to accelerate operation speed of the train appropriately within the range of the recognizable distance, so to ensure safe operation and as well as improve operation speed. With the scheme of the particular embodiment, operation speed of a train at a bend could be greatly accelerated. It is possible to solve the problem in existing art that the operation speed of the train at a bend need to be reduced greatly, which leads to low efficiency of train operation.

Figure 3:
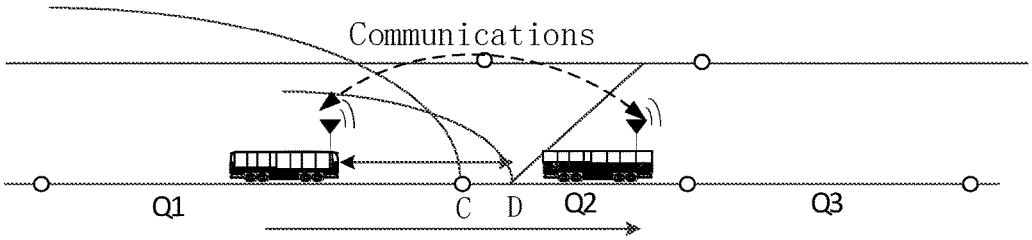
FIG. 3 is a schematic view of another specific application scenario of a train operation control system according to an embodiment of the present disclosure.

FIG. 3 shows another application scenario in an embodiment of the present disclosure. In the particular embodiment, the present train is running on section Q1, point C is the current running end of the first MA of the train, and point D is the current running end of the second MA; the point D is in front of the point C (i.e., the running end of the MA calculated by the active identification device 120 is in front of the running end of the MA calculated by the vehicle-vehicle communication device 110). Thus under this circumstance, the second MA calculated by the active identification device 120 can directly serve as the current final MA, and operation distance corresponding to such MA is greater than that of the MA calculated by the vehicle-vehicle communication device 110. Therefore, current operation speed of the train may be accelerated appropriately on basis of the operation speed of the second MA, so as to improve efficiency of train operation.

As can be seen from the actual application scenarios shown in FIGS. 2 and 3, the TCTCS provided by embodiments of the present disclosure is based on two different mobile authorization calculation schemes, which enable a train to operate with a relatively high speed under the premise of safe operation, and improve operation efficiency and reliability.

In TCTCS according to an embodiment of the present disclosure, the active identification device 120 is added on basis of mobile authorization calculation realized based on vehicle-vehicle communication, and the determination of the final MA of a train is realized by combination of the he vehicle-vehicle communication device 110 and the active identification device 120 together. For such a control system, in addition to improve safety of train tracking operation, it also improve operation efficiency of a train by combining actual calculation results of both the vehicle-vehicle communication device 110 and the active identification device 120, and is more in line with the practical application requirements. In case that there is a failure in vehicle-vehicle communication device or that there is an obstacle in operation track in the front, it may effectively prevent the train rear-end or collision accident, and better protect safety and reliability of train operation.

Figure 4:
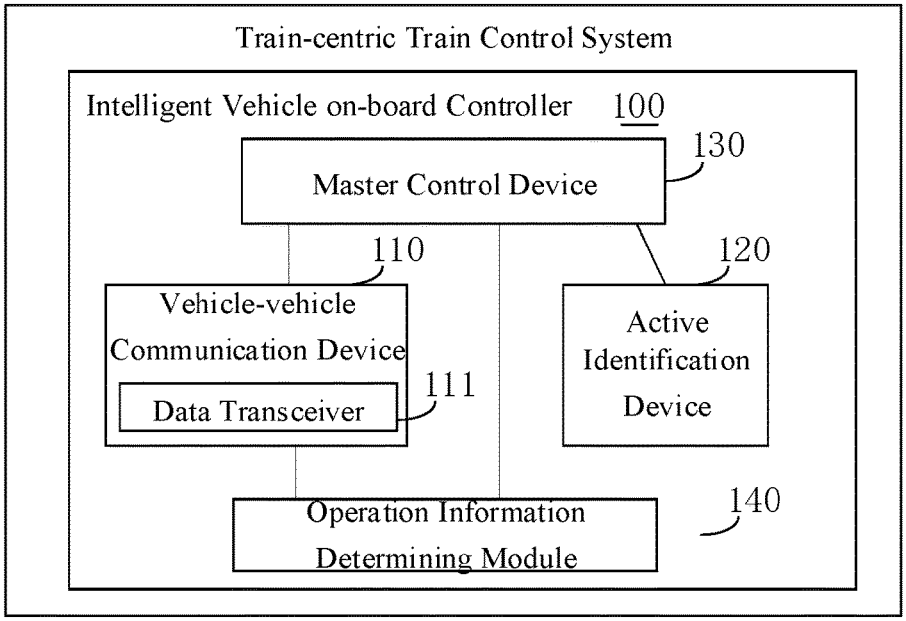
FIG. 4 is a schematic diagram of a vehicle on-board controller centered train operation control system in another embodiment of the present disclosure.

In an embodiment of the present disclosure, the TCTCS further comprises an operation information determining module 140, and the vehicle-vehicle communication device 110 comprises a data transceiver 111, as shown in FIG. 4.

The operation information determining module 140 is for determining current operation information of the present train and transmitting the current operation information of the present train to the vehicle-vehicle communication apparatus 110 and the master control device 130.

A data transceiver 111 is for broadcasting the current operation information of the present train and receiving current operation information of other trains broadcasted by the other trains.

In an embodiment of the present disclosure, the data transceiver 111 is preferably a data radio.

A data radio (also known as wireless data transmission station) is a high-performance professional data transmission station utilizing digital signal processing technology and software radio technology, with features such as reliable data transmission, low cost, easy installation and maintenance, wide cover range and so on; it is suitable for a plurality of wildly distributed points, complex geographical environment and other occasions. Therefore, use of data radio can be a good way to ensure inter-train data transmission in the scene of train operation, it broadcasts the train's position, direction of operation, operation speed and other operational information and receives digital communication from other trains capable of communication within scope of the data radio. Data radio obtains current operation information of other trains, and provides the master control device 130 with data for calculating the first MA.

Figure 5:
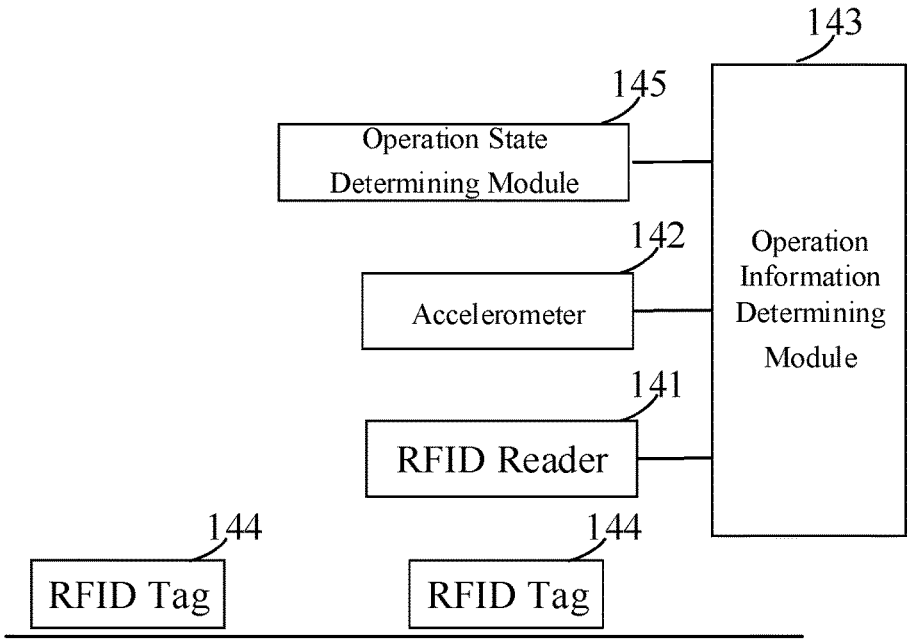
FIG. 5 is a schematic structural view of an operation information determining device according to an embodiment of the present disclosure.

In an embodiment of the present disclosure, the operation information determining module 140 may comprise an RFID reader 141, an accelerometer 142, and an operation information determining module 143 provided on the train, and RFID tag(s) 144 is disposed on train operation track at a predetermined interval, as shown in FIG. 5.

The RFID reader 141 is for reading tag information of the RFID tags passed by train operation, and the tag information comprises the tag position information and tag reading time.

The accelerometer 142 is for detecting current operation acceleration of the present train.

The operation information determination module 143 is for determining current position and the operation direction of the present train based on the tag information, and calculating current operation speed of the present train based on operation speed at a previous time and the current operation acceleration.

In practice, the RFID tag 144 may be arranged according to axle counter principle to locations such as entrance and exit of station, the inter-station, the turnout and the like. The RFID reader 141 may be mounted at the bottom of a train, and the tag information of the RFID tag 144 is read by the train during operation. Since mounting position of respective RFID tag 144 is fixed, the RFID reader 141 may basically determine location of a train by reading location information of the RFID tag 144 within communication range of RFID tag. Operation direction of a train may be determined based on the positions of the different RFID tag 144 read by the RFID reader 141 during train operation and the times of reading tags. The above-described train operation information determining device 140 provided by an embodiment of the present disclosure is simple and highly available.

Figure 6:
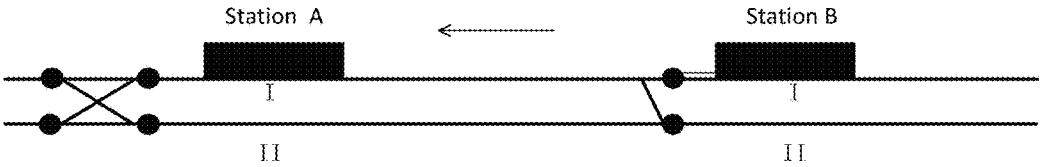
FIG. 6 is an arrangement diagram of RFID tags of an operation information determining device in an application scenario according to an embodiment of the present disclosure.

In the application scenario shown in FIG. 6, I and II represent the two directions of subway, and the black circle in the figure indicates the RFID tags 144 of the two stations of station A and station B. During train operation the RFID reader 141 firstly reads RFID tag 144 of the B station and then reads RFID tag 144 of the station A, thus the operation direction of the train is determined as from B to A (i.e., as shown by the arrow in the figure).

In an embodiment of the present disclosure, the accelerometer 142 may measure the acceleration value of train operation when the train is operation at variable speed, and calculate current operation speed of the train based on current acceleration value and operation speed at a previous time (the initial speed at which the current operation speed is calculated).

In an embodiment of the present disclosure, the operation information determining module 140 further comprises an operation state determining module 145 provided on the train, as shown in FIG. 5.

The operation state determining module 145 is used to determine operation state of the present train when the operation acceleration is zero, and the operation state is either constant motion or stationary.

The operation information determining module 143 is also used to determine current operation speed of the present train as operation speed at a previous time in case that the operation state is constant motion, and to determine the current operation speed of the present train as zero in case that the operation state is stationary.

In actual application scenario, the train may be operation at a constant speed or stationary during operation process, under such circumstance, measurement result of the accelerometer 142 is zero. Therefore, it is necessary to firstly determine whether the operation state of a train is constant motion or stationary, and then determine current operation speed of the train according to the operation state of the train. In an embodiment of the present disclosure, the operation state determining module 145 may be implemented as an optical flow camera, or train motion trends may be determined by a lidar (using Doppler Effect). The optical flow camera mainly utilizes feature points in successive pictures captured by itself, compares whether there is a change in vertical and horizontal pixels of feature points location of the successive pictures. If there is a change, the motion trend is determined as motion; otherwise it is determined as stationary. Lidar uses Doppler Effect to determine movement of the train trend.

Figure 7:
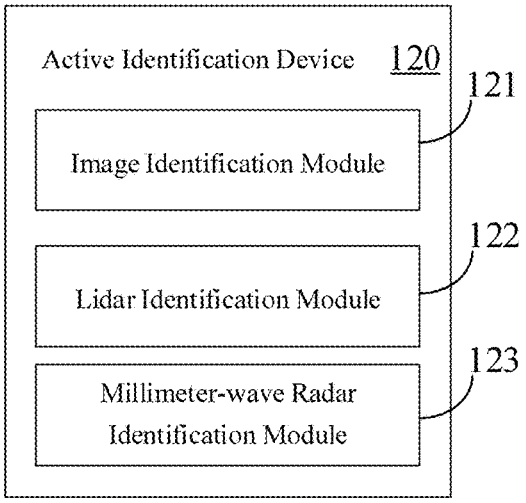
FIG. 7 is a schematic structural view of an active identification device in an embodiment of the present disclosure.

FIG. 7 shows a schematic structural view of the active identification device 120 according to an embodiment of the present disclosure. As shown in FIG. 7, the active identification device 120 of an embodiment of the present disclosure may comprise at least one of an image identification module 121 and a lidar identification module 122.

The image identification module 121 is for capturing a front image during operation of the present train and determining whether there is an obstacle in front of the operation based on the front image and the preset track template image. When it is determined that there is an obstacle, the image identification module 121 determines a first distance between the obstacle and the train based on pixel position of the obstacle in the front image and pre-set mapping relationship between pixel position and distance.

The lidar identification module 122 is for obtaining scene image in front of the train operation by a lidar, and determining whether there is an obstacle in front of the operation of the train according to the scene image and the preset digital scene map along the track. In case that an obstacle is determined as being exist, a second distance between the obstacle and the train is determined through the lidar.

The image identification module 121 captures the front image of the present train during train operation according to a pre-set time interval, and identifies obstacle(s) in the image to obtain the distance between the obstacle and the train. Wherein an image identification algorithm may be selected according to the actual application needs.

In a particular embodiment of the present disclosure, the image identification algorithm may be an image identification algorithm based on semantic segmentation, and the algorithm can realize detection and visibility calculation of an obstacle in front of the train operation (i.e., calculating distance between the train and the obstacle). In particular, an operation scene model of an scene image of train operation track is established based on deep learning so as to obtain a series of track template images; and a mapping relationship between pixel position of image and actual distance is established according to the distance between head end of the train and the position of the actual scene corresponding to the pixel position in the template image. In a process of identifying the actual train operation, it is identified whether there is an obstacle in the front image by comparing the front image acquired during train operation with the track template image obtained from modeling. In case that an obstacle is identified, a first distance between the obstacle and the present train is determined according to pixel position of the obstacle in the front image and mapping relationship between the above pixel position and distance.

The lidar identification module 122 is implemented using lidar imaging and pulse signal ranging. In an embodiment of the present disclosure, the digital scene map along the track is obtained by the following steps: controlling a train to run throughout the whole operation route (i.e., track); collecting scene data in front of the train by a lidar mounted on the train; completing route feature identification and model for the entire route according to the collected scene data through deep learning; and forming a digital map through deep learning. That is, the digital scene map is obtained by collecting date of actual operation route modeling of the collected actual data. Wherein the collected data is real-time route data indicating that there is no obstacle on the operation route, and based on the digital map, an actual scene in which there is obstacle is not present in the train operation route is capable of being learnt. For example, the actual scene may be that there is an object in certain location on the route (e.g., a semaphore or other device), with another object in another location on the route (e.g., poles). During process of train operation, location of the present train may be learnt through the digital scene map without location information of Automatic Train Protection (ATP). Further, it is determined whether there is an obstacle in front of operation route according to learnt scene of the current location; if there is an obstacle that affects the operation of a train, the distance between the train and the obstacle (i.e., the second distance) is obtained by the lidar.

In case that the active identification device 120 is the image identification module 121, identification result transmitted from the active identification device 120 to the master control device 130 is the identification result of the image identification module 121, and the distance contained in the identification result is the first distance. In case that the active identification device 120 is the lidar identification module 122, the identification result transmitted from the active identification device 120 to the master control device 130 is the identification result of the lidar identification module 122, and the distance contained in the identification result is the second distance.

In an embodiment of the present disclosure, the active identification device 120 preferably comprises both the image identification module 121 and the lidar identification module 122. Under such circumstance, identification result transmitted by the active identification device 120 to the master control device 130 comprises both identification result of the image identification module 121 and identification result of the lidar identification module 122.

Under such circumstance, the master control device 130 is specifically configured to: calculate a second MA of the present train based on the second distance in case that a difference between the first distance and the second distance is less than a first pre-set distance, and calculate the second MA of the present train based on the smaller one between [00104] the first distance and the second distance in case that the difference between the first distance and the second distance is not less than the first pre-set distance.

In the practice, although the image identification module 121 is able to accurately identify an obstacle in front of the train operation route and calculate the first distance, it is easily influenced by external factors such as the environment and the weather. For example, in case of poor environment (e.g., rainy), the identification result would be greatly affected and thereby would be not accurate enough. On the other hand, the lidar identification module 122 performs obstacle identification and ranging based on a lidar, the ranging accuracy of which is higher than that of the image identification module 121; further, it would get less influenced by external factors such as the environment and the weather. Therefore, accuracy of obstacle identification could be effectively improved by combining the image identification module 121 and the lidar identification module 122, with respective advantages of the two being combined.

Specifically, if the difference between the first distance determined by the image identification module 121 and the second distance determined by the lidar identification module 122 is less than the first set distance, it can be determined that the obstacle identified by the two is the same obstacle. Since the ranging accuracy of the lidar identification module 122 is higher than that of the image identification module 121, the second MA of the present train is calculated with the second distance determined by the lidar identification module 122. If the difference between the first distance and the second distance is not less than the first pre-set distance, it can be determined that the obstacles identified by the two are likely not one same obstacle, then the second MA of the present train is calculated based on the smaller one of the first distance and the second distance, so as to ensure safety of train operation.

In an embodiment of the present disclosure, the active identification device 120 may further comprise a millimeter-wave radar identification module 123, as shown in FIG. 7.

The millimeter-wave radar identification module 123 is for determining a third distance between the obstacle and the train by the millimeter-wave radar when the image identification module 121 or the lidar identification module 122 determines that an obstacle exists.

Under such circumstance, the master control device 130 is specifically configured to calculate the second MA of the present train in case that the difference between the first distance and the third distance is less than a second pre-set distance, or that the difference between the second distance and the third distance is less than a third pre-set distance.

Figure 8:
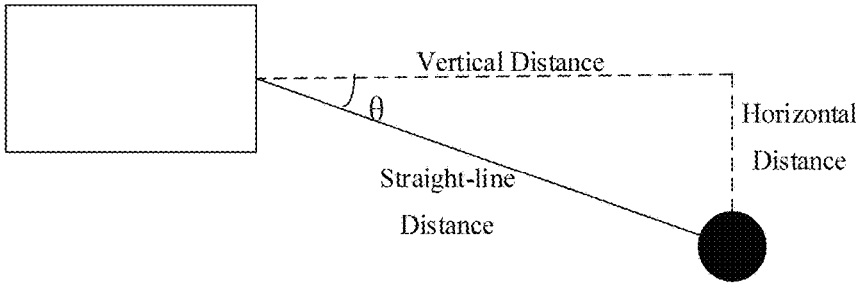
FIG. 8 is a schematic diagram of a millimeter-wave radar identification module positioning obstruction in an embodiment of the present disclosure.
Figure 9:
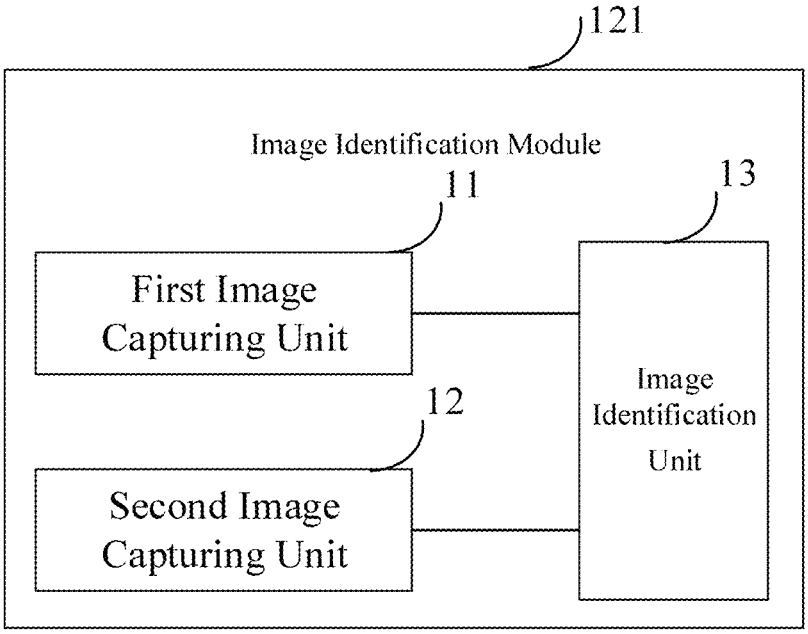
FIG. 9 is a schematic diagram of the structure of an image identification module in an embodiment of the present disclosure.
Figure 10:
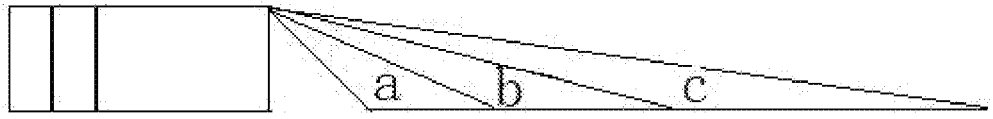
FIG. 10 is a schematic view of the line-of-sight range of the telephoto camera and the wide-angle camera in an embodiment of the present disclosure.

The millimeter-wave radar identification module 123 works based on a millimeter-wave radar, and measures an object in the front by pulse signals. The millimeter-wave radar has a phased array antenna, it calculates straight-line distance between the obstacle and the radar and angle θ between transmitted beam and the direction in which the train runs directly based on the speed of light and round-trip time of a directional narrow beam between the obstacle and the radar, as shown in FIG. 8. After calculating above-mentioned straight-line distance and angle θ, vertical distance and horizontal distance between the train and the obstacle may be further determined, so as to obtain accurate position of the obstacle (indicated by the black dot in the figure).

In an embodiment of the present disclosure, the image identification unit 13 is also used to identify train track type in the first front image and train track type in the second front image and transmit the track type identification result to the master control device 130, wherein train track type comprises single track or turnout. As such, the identification result filtering rule comprises the following items.

If the train track type in the first front image and the train track type in the second front image are both single tracks, then the fourth distance is determined as the first distance.

If the train track type in the first front image and the train track type in the second front image are both turnouts, the fifth distance is determined as the first distance.

If the train track type in the first front image and the train track type in the second front image are different types (that is, one is a single track and the other is a turnout), the distance between the obstacle determined based on the front image corresponding to the turnout and the train is determined as the first distance.

In other words, in case that dual cameras (i.e., a telephoto camera and a wide-angle camera) identify a single track scene, identification result of the telephoto camera is employed; in case that the dual cameras identify a turnout scene, identification result of the wide-angle camera is employed; and in case that one of the dual cameras identifies a single track scene and the other identifies a turnout scene, identification result of the camera that identifies more track is employed. Wherein identification of train track type may use a large number of the track templates as standard training samples, characteristics of the train track may be extracted by the standard training, and the track type in the front image may be identified based on the characteristics.

In practice, one or two sets of master control devices may be set on head and trail of a train respectively; in general, master control devices are implemented as secure computer. With redundancy configuration scheme, a train is enabled to operate properly even when one set of master control devices is in failure.

Figure 11:
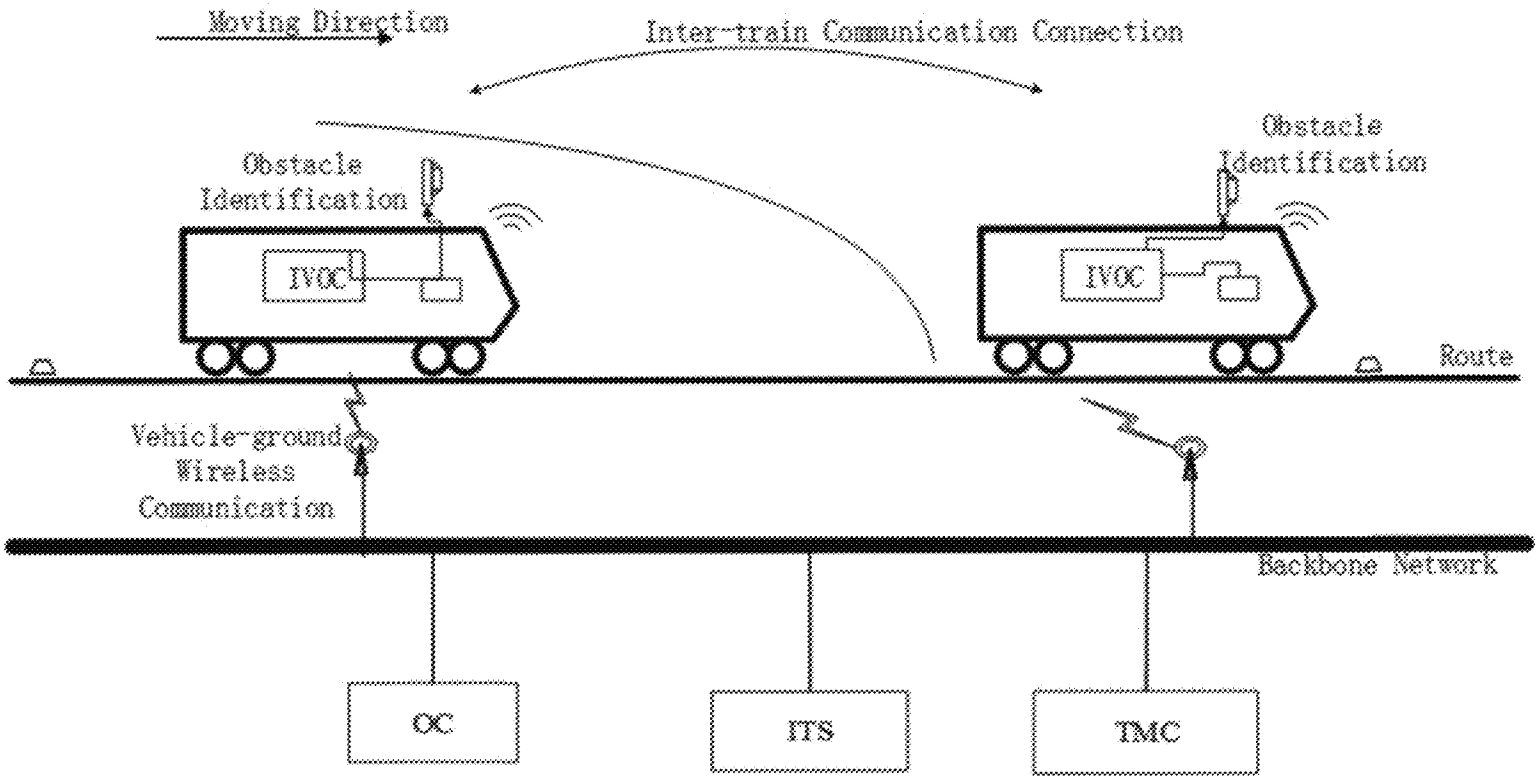
FIG. 11 is a schematic diagram of a vehicle on-board controller centered train operation control system in a particular embodiment of the present disclosure.

It should be noted that in addition to the above-described components clearly described in embodiments of the present disclosure, the TCTCS provided in an embodiment of the present disclosure comprises other components necessary for the safety operation control system of a train. As shown in FIG. 11, in addition to an active identification device integrated in IVOC, a vehicle-vehicle communication device and a master control device for inter-train communication link, TCTCS according to an embodiment of the present disclosure comprises necessary component such as Intelligent Train Supervision (ITS) system, object controller (OC), train management center (TMC), data communication system (DCS) and so on. In addition, in practice the IVOC of the an embodiment of the present disclosure further comprises a Man-Machine Interface (MMI) module, a Balise Transmission Module (BTM), an Intelligent Train Operation (ITO) subsystems, and etc. The vehicle-vehicle communication device, the active identification device and the master control device may be integrated into an Intelligent Train Protection (ITP) subsystem of the IVOC.

For a TCTCS according to an embodiment of the present disclosure, inter-train information exchange may be performed by a vehicle-vehicle communication device after current operation of the present train is determined by the operation information determining module; or it may be performed through the following items: a train obtains train list in the OC area by establishing a communication connection with trains within the list, and operation information (e.g., locations and operation speed, and etc.) is exchanged between the trains after the communication connection is established. Upon receiving train operation information in the current area, the train determines its adjacent train (the adjunct train in front capable of communication) based on location information of other trains and their location relationship with the train, to accomplish train selection, train in front identification and thereby protect the train from accident related to the train in front. IVOC combined with the active identification device monitors train as well as other obstacles in front in real time, so as to ensure speed protection of the train. IVOC may take form of modular design, train head and tail can be configured with two sets of double 2-vote-2 safety computer platform, or a single set of platform.

Figure 12:
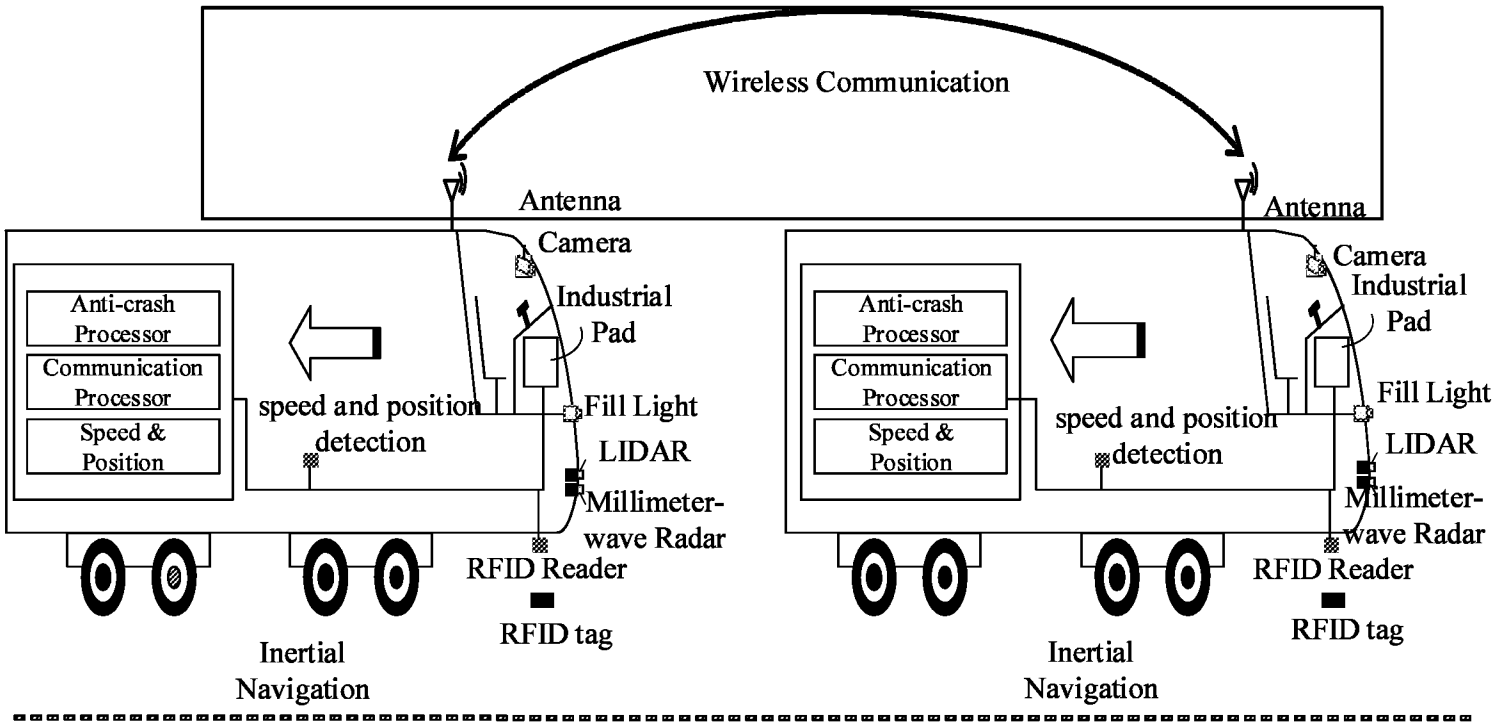
FIG. 12 is a schematic view showing a practical scenario of a vehicle on-board controller centered train operation control system in a particular embodiment of the present disclosure.

FIG. 12 shows a schematic diagram of a practical application scenario of vehicle on-board controller centered train operation control system according to a preferred embodiment of the present disclosure. As shown in FIG. 12, according to the present embodiment, the camera of the image identification module of the active identification device, the lidar of the lidar identification module, and the millimeter-wave radar of the millimeter-wave radar identification module are all installed in head of the train. In order to improve identification effect of the identification modules, a fill light(s) may also be set to improve accuracy of active identification in case of poor light. With the result of identification of the active identification device, a train may be controlled by a crash handler in the presence of an obstacle for in-time braking. When there is a train incapable of communication in the route, and that the distance between the train incapable of communication and the present train is relative long, operation speed of the present train may be ensured and the overall operation efficiency of the system may be improved. The train is also equipped with a speed and position detection module, the module measure speed based on inertial navigation system, speed sensor (test positioning as shown in the figure), inertial navigation, it uses satellite, ground transponder and speed integration to achieve independent positioning of a train The master control device of the present embodiment may be implemented directly using an industrial pad. For the train speed detection, the system may take form of modular design, and define standard speed interface, so that the system supports different speed program access, without the need to change interface and speed detection module when speed sensor changes. A communication processor automatically controls vehicle-vehicle and vehicle-ground communication.

Functional blocks shown in block diagrams described above may be implemented as hardware, software, firmware, or a combination thereof. When implemented in hardware, it may be, for example, electronic circuits, application specific integrated circuits (ASICs), suitable firmware, plug-ins, function trains, and the like. When implemented in software, elements of the present disclosure are programs or code segments that are used to perform the desired tasks. The program or code segment may be stored in a machine-readable medium or transmitted over a transmission medium or a communication link through a data signal carried in carriers. Machine-readable media may comprise any medium capable of storing or transmitting information. Examples of machine-readable media comprise electronic circuits, semiconductor memory devices, ROM, flash memory, erasable ROM (EROM), floppy disks, CD-ROMs, optical disks, hard disks, optical media, radio frequency (RF) links, and the like. The code segments may be downloaded via a computer network such as the Internet, an intranet, or the like.

The present disclosure may be embodied in other specific forms without departing from the spirit and essential characteristics thereof. For example, the algorithms described in the particular embodiments may be modified while the system architecture is not departing from the essential spirit of the present disclosure. Accordingly, the present embodiments are to be considered in all respects as illustrative and not restrictive, the scope of the present disclosure being defined by the appended claims rather than by the foregoing description. Further, all changes falling within the meaning and equivalents of the claims are considered to be within the scope of the present disclosure.

What is claimed is:

1. A vehicle on-board controller centered train operation control system, the control system comprises intelligent vehicle controllers (IVOCs) provided on respective trains, each of the IVOCs comprises a vehicle-vehicle communication device, an active identification device and a master control device; wherein:

the vehicle-vehicle communication device is configured to exchange information between trains and obtaining current operation information of other trains, and transmitting current operation information of the other trains to the master control device; wherein the current operating information comprises but is not limited to current position, direction and speed of operation of the other trains;

the active identification device is configured to determine whether an obstacle exists in front of the present train, in case that it is determined that the obstacle exists, a distance between the obstacle and the present train is determined and an identification result is transmitted to the master control device, wherein the identification result comprises a determination result and the distance between the obstacle and the vehicle when existence of the obstacle is determined, a recognizable distance of the active identification device is greater than the emergency braking moving distance of the present train and is not greater than the minimum safe operation distance between adjacent trains;

the master control device is configured to receive the current operation information of other trains transmitted by the vehicle-vehicle communication device, and the identification result transmitted by the active identification device; determining the adjacent train in front capable of communication based on current operation information of the present train and current operation information of other trains, calculating a first Movement Authority (MA) based on the current operation information of the present train and the current operation information of the adjacent train in front capable of communication, in case that the identification result indicates that there is no obstacle, the first MA is determined as final MA of the present train, in case that the identification result indicates that there is the obstacle, a second MA is determined according to the distance in the identification result, the final MA of the present train is determined based on the first MA and the second MA.

2. The control system according to claim 1, wherein the master control device is configured to determine the second MA as the final MA in case that a running end of the first MA is in front of a running end of the second MA, and to determine the first MA or the second MA as the final MA in case that the running end of the second MA is in front of the running end of the first MA.

3. The control system according to claim 1, wherein each of the IVOCs further comprises:

an operation information determining device configured to determine current operation information of the present train and transmitting the current operation information of the present train to the vehicle-vehicle communication apparatus and the master control device; and the vehicle-vehicle communication device comprises a data transceiver configured to broadcast the current operation information of the present train and receive current operation information of other trains broadcasted by the other trains.

4. The control system according to claim 3, wherein the data transceiver comprises a data radio.

5. The control system according to claim 3, wherein the operation information determining device comprises an RFID reader, an accelerometer, and an operation information determining module provided on the present train, and RFID tags are disposed on train operation track at a predetermined interval;

the RFID reader is configured to read tag information of the RFID tags passed by train operation, and the tag information comprises the tag position information and tag reading time;

the accelerometer is configured to detect current operation acceleration of the present train; and the operation information determining module is configured to determine current position and the operation direction of the present train based on the tag information, and calculate current operation speed of the present train based on operation speed at a previous time and the current operation acceleration.

6. The control system according to claim 5, wherein the operation information determining device further comprises an operation state determining module provided on the present train, the operation state determining module is configured to determine operation state of the present train when the operation acceleration is zero, and the operation state is either constant motion or stationary;

the operation information determining module is also configured to determine current operation speed of the present train as operation speed at a previous time in case that the operation state is constant motion, and to determine the current operation speed of the present train as zero in case that the operation state is stationary.

7. The control system according to claim 1, wherein the active identification device comprises:

an image identification module configured to capture a front image during operation of the present train and determining whether there is an obstacle in front of the operation based on the front image and a preset track template image, when it is determined that there is the obstacle, the image identification module determines a first distance between the obstacle and the present train based on pixel position of the obstacle in the front image and pre-set mapping relationship between predetermined pixel positions and predetermined distance.

8. The control system according to claim 7, wherein the master control device is configured to: calculate a second MA of the present train based on the second distance in case that a difference between the first distance and the second distance is less than a first pre-set distance, and calculate the second MA of the present train based on the smaller one between the first distance and the second distance in case that the difference between the first distance and the second distance is not less than the first pre-set distance.

9. The control system according to claim 7, wherein said active identification device further comprises:

a millimeter-wave radar identification module configured to determine a third distance between the obstacle and the present train by the millimeter-wave radar when the image identification module determines that obstacle exists;

wherein the master control device is configured to calculate, in case that the difference between the first distance and the third distance is less than a second pre-set distance, or that the difference between the second distance and the third distance is less than a third pre-set distance, the second MA of the present train according to the third distance.

10. The control system according to claim 7, wherein the image identification module comprises a first image capturing unit and a second image capturing unit, the first image capturing unit and the second image capturing unit are respectively connected to the image identification module;

the master control device, configured to control the first image capturing unit and the second image capturing unit to capture images synchronically;

the first image capturing unit is configured to capture a first front image in during the train operation;

the second image capturing unit is configured to capture a second front image in during the train operation; and an image identification unit is configured to determine whether there is the obstacle in front of the operation route according to the first front image and a pre-set first track template image, and in case that there is the obstacle, a fourth distance between the obstacle and the present train is determined based on a first mapping relationship between predetermined distances and predetermined pixel positions and pixel position of the obstacle in the first front image to obtain a first identification result, the image identification unit is also configured to determine whether there is the obstacle in front of the operation route according to the second front image and a pre-set second track template image, and in case that there is the obstacle, a fifth distance between the obstacle and the present train is determined based on a second mapping relationship between predetermined distances and predetermined pixel positions and pixel position of the obstacle in the second front image to obtain a second identification result, the first identification result and second identification result are sent to the master control device;

wherein the master control device further determines a distance contained in the identification result that indicates there is an obstacle as a first distance in case that only one of the first identification result and the second identification result indicates an obstacle; and select the first distance from the fourth distance and the fifth distance according to predetermined identification result selection rules in case that both the first identification result and the second identification result indicate obstacles.

11. The control system according to claim 10, wherein the first image capturing unit is a telephoto camera, and the second image capturing unit is a wide angle camera.

12. The control system according to claim 10, wherein:

the image identification unit is further configured to identify train track type in the first front image and train track type in the second front image, and transmit the track type identification result to the master control device, wherein the train track types is one of single track and turnout;

wherein identification results selection rules comprise:

if the train track type in the first front image and the train track type in the second front image are respectively single tracks, then the fourth distance is determined as the first distance;

if the train track type in the first front image and the train track type in the second front image are respectively turnouts, the fifth distance is determined as the first distance;

if the train track type in the first front image and the train track type in the second front image are different types, then the distance between the obstacle determined based on the front image corresponding to the turnout and the present train is determined as the first distance.

13. The control system according to claim 1, wherein the active identification device comprises:

a lidar identification module configured to capture a scene image in front of the train operation by a lidar, and determine whether there is an obstacle in front of the operation of the present train according to the scene image and the preset digital scene map along the track, in case that the obstacle is determined as being exist, a second distance between the obstacle and the present train is determined through the lidar.

14. The control system according to claim 13, wherein the master control device is configured to: calculate a second MA of the present train based on the second distance in case that a difference between the first distance and the second distance is less than a first pre-set distance, and calculate the second MA of the present train based on the smaller one between the first distance and the second distance in case that the difference between the first distance and the second distance is not less than the first pre-set distance.

15. The control system according to claim 13, wherein said active identification device further comprises:

a millimeter-wave radar identification module configured to determine a third distance between the obstacle and the present train by the millimeter-wave radar when the lidar identification module determines that the obstacle exists;

wherein the master control device is configured to calculate, in case that the difference between the first distance and the third distance is less than a second pre-set distance, or that the difference between the second distance and the third distance is less than a third pre-set distance, the second MA of the present train according to the third distance.

* * * * *